US005560540A

United States Patent [19]

Amendola

[11] Patent Number: 5,560,540

[45] Date of Patent: Oct. 1, 1996

[54] MAILBOX DELIVERY SIGNAL DEVICE

[76] Inventor: Joseph Amendola, 630 Washington St., Franklin, Mass. 02038

[21] Appl. No.: 427,757

[22] Filed: Apr. 24, 1995

[51] Int. Cl.[6] ..... B65D 91/00

[52] U.S. Cl. ..... 232/35

[58] Field of Search ..... 232/17, 34–37

[56] References Cited

U.S. PATENT DOCUMENTS

| | | | |
|---|---|---|---|
| 400,244 | 3/1889 | Mitchell | 232/35 |
| 1,248,171 | 11/1917 | Schubert | 232/35 |
| 4,655,390 | 4/1987 | Martin | 232/35 |
| 4,840,307 | 6/1989 | Hartman | 232/35 |
| 4,869,425 | 9/1989 | Chiou | 232/34 |
| 5,388,759 | 2/1995 | Barnes | 232/35 |

FOREIGN PATENT DOCUMENTS

| | | | |
|---|---|---|---|
| 559561 | 9/1932 | Germany | 232/34 |

*Primary Examiner*—Flemming Saether
*Attorney, Agent, or Firm*—Robert J. Doherty

[57] ABSTRACT

A mailbox signal device positioned entirely on the interior surface of the cover of a rural mailbox through which a signal opening is provided wherein the signal device includes a spring mounted panel visible through the signal opening in its signal position and maintained is a non-signal position until the mailperson delivers mail to the box thereby providing a convenient way to determine whether or not mail has been delivered to the box.

8 Claims, 2 Drawing Sheets

MAILBOX DELIVERY SIGNAL DEVICE

BACKGROUND AND OBJECTS OF THE INVENTION

This invention deals with a mailbox and more particularly to a mailbox having a signal device or indicator which is visible from the distance such that the user thereof can tell whether or not mail has been deposited in the box since the last time the box was checked. This obviously would save a great deal of time, exposure to the elements, etc. when properly functioning; and, accordingly, this general idea has been the subject matter of a great many patents and inventions in the past—none of which are believed pertinent to this specific invention.

Some of the drawbacks of previous devices of this general nature have been that they require a complete specific mailbox structure to be operable, are costly or complex to install or maintain and are subject to wear and tear or corrosion by exposure on the exterior mailbox surfaces. Thus it would be desirable to achieve the overall objectives of desired signaling from the distance with a device or system which is mounted essentially entirely inside the mailbox such that it is not subject to corrosion, rust, etc. And is not overly complex or expensive.

A still further object of the present invention would be the provision of such a device which is mounted entirely on the cover portion of the mailbox such that the device of the present invention could be installed on one's presently existing mailbox.

These and other objectives of the present invention are accomplished by a mailbox signal device for use with a mailbox in turn having a front door in turn having interior and exterior surfaces and pivotally mounted at the bottom of said mailbox between open and closed positions, said signal device being entirely mounted to the interior side of said mailbox door and including a signal opening provided in said front door, a signal panel pivotally mounted to said front door interior side and movable between a first position wherein said signal panel is held away from said signal opening and a second position wherein said signal panel is positioned behind said signal opening so as to be visible through said signal opening, spring means for constantly urging said signal panel to said second position and holding means for temporarily holding said signal panel in its first position when said front door is in its closed position and releasing said signal panel when said front door is opened.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DETAILED DESCRIPTION OF THE INVENTION

Figure 1:
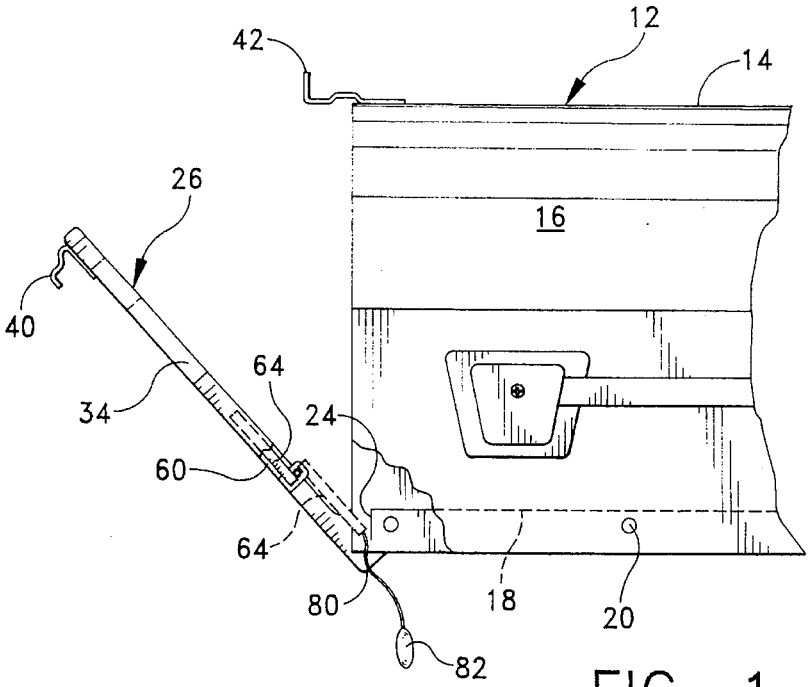
FIG. 1 is a partial side elevational view with the front door in a partially closed position preparatory to full closure and retention of the signal flap of the present invention in its non-visible position.
Figure 2:
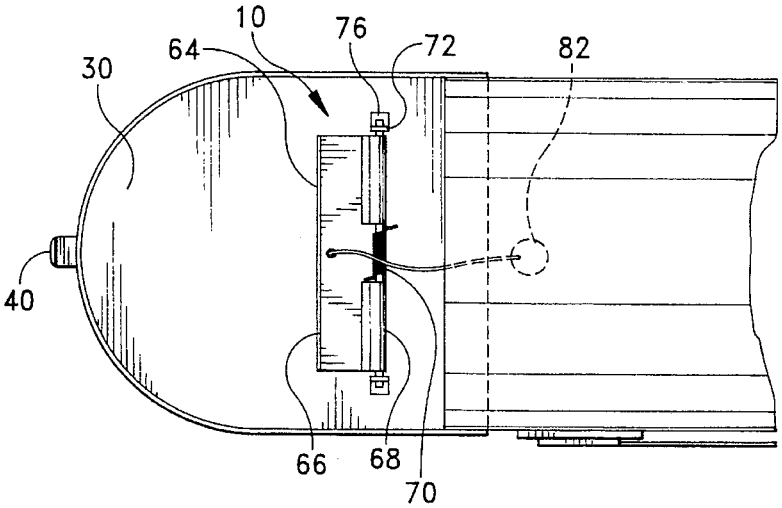
FIG. 2 is a top plan view of a portion of the mailbox showing the cover in the fully opened position with the flap in the active signal position.
Figure 6:
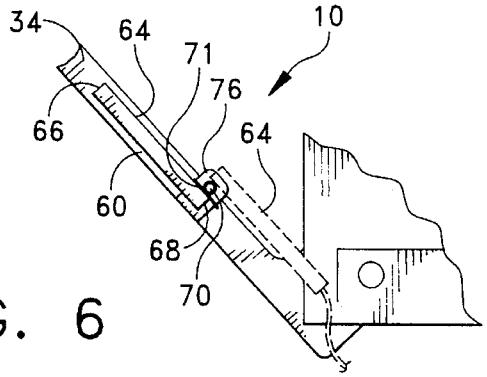
FIG. 6 is an enlarged side sectional view of the cover showing the pivotal action of the signal panel or flap.
Figure 3:
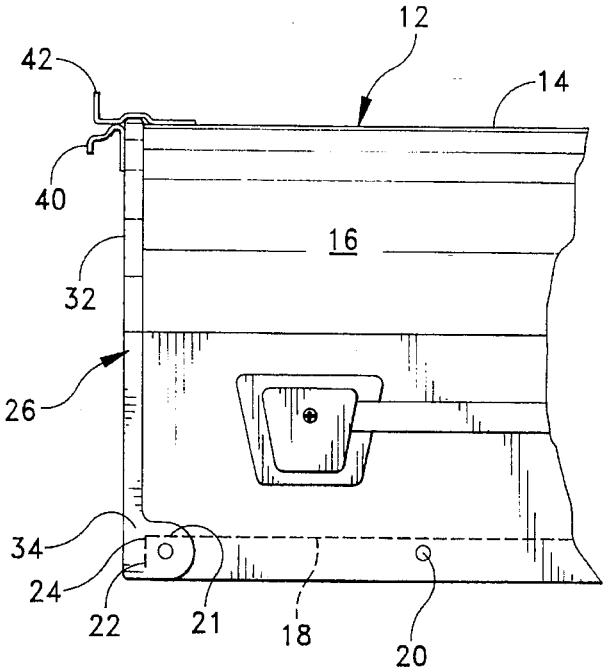
FIG. 3 is a partial side elevational view similar to FIG. 1 but showing the cover in the fully closed position.

As best shown in FIGS. 1 through 6 of the drawings, the signal device 10 of the present invention is adapted for use in conjunction with a standard rural mailbox 12 having a tubular elongated hollow body 14 having downwardly extending sides 16 and terminating in a bottom wall 18 connected to the side 16 as by rivets or other fastening means 20. Generally the bottom wall front edge 21 terminates in a downwardly extending bottom shelf 22, the outer surface 24 of which faces the front door 26 of the mailbox.

Such front door 26 includes a main panel 28 having exterior and interior surfaces 30 and 32 respectively. A peripheral side wall 34 generally provides a suitable hinged connection to the side wall 16 of the box enabling the front door to pivotally swing between open and closed positions such that mail may be deposited and retrieved from the bottom shelf 18 thereof. Also a pull 40 for engagement with the user's fingers is connected to the upper portion of the exterior surface 32. A friction lock 42 may be mounted to the upper portion of the tubular body 14 such that upper portions of the front door or the pull 40 are engaged by lower surfaces of the friction lock 42 and thus secures the front door in its closed position.

The signal device 10 of the present invention includes a signal opening 60 extending through the main panel of the front door such that one may visually look through the signal opening from outside and view the interior of the mailbox. The signal opening 60 may take any form, and the form herein depicted has openings in the form of four letter cut-outs spelling the word "MAIL", that is, the outlines of the letters composing the word "MAIL" are, in fact, individual cut-out portions. Alternatively, it is not necessary that words be spelled or the opening be discontinuous or that it be regular in shape—all that is necessary is that there is visual access through the front door panel in the form of a signal opening, in fact, outlines of animals or scenic views might be provided through appropriate cut-outs.

A signal flap 64 is provided and of a shape and extent to match that of the signal opening 60 but generally so that when the signal flap or panel is in its operating signal position, it can be viewed through the opening so as to provide a distinctive appearance, i.e., through color reflectivity and the like, such that distinctive appearance by the user from the desired use distance is achieved. Generally, the signal panel is flat and includes opposed upper and lower edges 66 and 68 respectively. The lower edges include outwardly extending trunnions 70 most often in the form of a metal pin laterally extending through the panel as when such is made from sheet metal and the like, and it includes upwardly extending bottom tangs 72 which serve to capture the rod or pin within the panel. Obviously, however, the panel may be made from any suitable material including cardboard, plastic and the like. The opposed ends of the pins or trunnions are retained on the inside surface of the front door by means of opposed retaining cups 76 suitably affixed to the front door inner surface as by brazing and the like.

Figure 4:
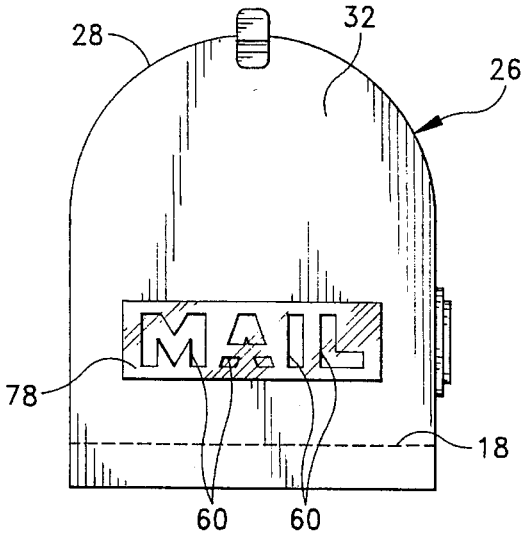
FIG. 4 is a front elevational view showing the front of the mailbox as shown in FIG. 3 in its non-signal position.
Figure 5:
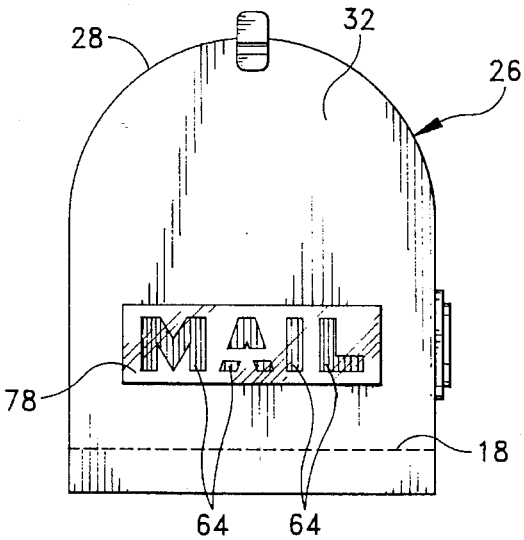
FIG. 5 is a view of the front of a mailbox in the active signal position, that is, wherein the cover which has been opened to activate the signal device of the present invention and thereafter closed such that a distinctive color is visible through the openings spelling the word "MAIL" in the front cover.

The above-mentioned construction provides for the pivotal connection of the panel to the interior door surface. In addition to this construction, a spring 71 preferably a coil spring wrapped around the central portion of the rod 70 and having opposed spring ends simultaneously engaging both the outer surface of the panel and the inner surface of the front door serves to continually urge the signal flap or panel to the position shown in FIG. 2 but may be easily overcome by the force of the user's fingers in moving the flap to the alternate non-signal position as shown in FIGS. 1 or 4. In this respect, it should be pointed out that the distinctive visual appearance of the inner surface 6f the panel will be thus visible through the signal opening(s) when the panel is in the signal position shown in FIGS. 2 and 5 and not visible in the non-signal position of FIGS. 1 and 4 but that the signal opening in the non-visible position is still visually open, that is, one could look through the signal opening(s) through the front door into the interior portions of the mailbox unimpaired by the non-signal position of the panel. Without light entering the interior of the mailbox and the necessity of viewing close up this feature is not generally practical. In this respect, it should also be noted that it is generally advisable to cover such signal opening(s) with some translucent or transparent material 78 such that wind driven rain and like is not accessible through the signal opening(s) to the interior mailbox portions or indicator device of the present invention.

In positioning the signal panel to the non-visible or non-signal position, it may either be placed in the position of FIG. 1 by one's fingers and then the cover moved to its fully closed position while simultaneously withdrawing one's fingers being careful to permit the inner panel surface to extend below the adjacent portion of the bottom wall 18 or the downwardly extending shelf 22 thereof in those cases where such is provided so it bears against the adjacent surface 24. Thus the co-action of the panel spring urged against the bottom 18 forms the holding means by which the panel is maintained in the first or non-signal position. Of course, the signal flap or panel must be of a vertical extent so that it will extend between the door inner surface and the bottom wall surface 24. Alternatively, a string 80 with a tab 82 provided at one end thereof is connected to the upper portion of the panel at the other end thereof such that downward or angular pulling of the string serves to position the panel in its first non-signal position as the front door is swung to its closed position without the inconvenience of manipulating the panel with one's fingers.

It should also be brought out that in some cases, it may be desirable that instead of orienting the signal flap 64 with its bottom edge 68 below the signal opening, it could be arranged so as to be disposed adjacent the upper edge of the signal opening then operated so as to swing downwardly over the signal opening in which case the rear surface of the signal flap would be that which is provided with the contrasting color, etc. so as to show through the opening and subsequent closing of the front door. In such alternative construction, the signal panel upon being upwardly flipped 180° would present its top 66 adjacent the spring release 42 and such top 66 could be altered in form, e.g., slightly outwardly bent to contact the face of the spring release 42 and thus hold it in this alternative first or non-signal position in that manner.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A mailbox signal device in combination with a mailbox having a body open at one end to define an open end with a bottom and provided at said open end with a hinged door attached to said body, said door having interior and exterior surfaces and being pivotally mounted at the bottom of said body for movement between open and closed positions, said signal device being entirely mounted to the interior side of said door and including a signal opening provided in said door, a signal panel pivotally mounted to said door interior side and movable between a first position wherein said signal panel is held away from said signal opening and a second position wherein said signal panel is positioned behind said signal opening so as to be visible through said signal opening, spring means for constantly urging said signal panel to said second position and holding means for temporarily holding said signal panel in its first position when said door is in its closed position and releasing said signal panel when said door is opened.

2. The device of claim 1, said signal panel being generally flat and having bottom and top edges and pivotally connected to said door interior side adjacent said signal opening.

3. The device of claim 2, said mailbox having a bottom wall terminating adjacent said door in a downwardly extending shelf, said panel bottom edge positioned below said signal opening and said panel top edge extending between said mailbox body bottom wall shelf and said interior wall of said door in said first position wherein said upper portions of said signal panel contact said shelf so as to form said holding means.

4. The device of claim 2, said signal panel having a trunnion laterally extending from each side of said panel bottom edge, receiving means mounted on the inside surface of said cover for receiving said trunnions, said spring means mounted on said cover inside surface, said spring means contacting said panel so as to constantly urge said panel to said second position.

5. The device of claim 4, said signal panel top edge positioned above said signal opening in said second position.

6. The device of claim 5, said signal panel having opposed inner and outer surfaces wherein the panel inner surface is provided with a contrasting color visible through said signal opening when said signal panel inner surface is disposed face to face with respect to said signal opening in said second position.

7. The device of claim 2, said mailbox body having a bottom wall terminating adjacent said door, said panel bottom edge positioned below said signal opening and said holding means extending from said panel downwardly between said mailbox body bottom wall and said door interior surface.

8. The device of claim 7, said holding means being a cord connected at one end thereof to said panel and wherein the other end thereof extends below said mailbox body bottom wall such that grasping and pulling said other cord end positions said in said first position.

* * * * *